US007648124B2

(12) United States Patent
Beers

(10) Patent No.: US 7,648,124 B2
(45) Date of Patent: Jan. 19, 2010

(54) BOAT DRAIN PLUG RECEPTACLE

(76) Inventor: Michael Beers, 9903 Inca La., Austin, TX (US) 78733

( * ) Notice: Subject to any disclaimer, the term of this patent is extended or adjusted under 35 U.S.C. 154(b) by 81 days.

(21) Appl. No.: 11/704,575

(22) Filed: Feb. 9, 2007

(65) Prior Publication Data

US 2008/0190351 A1 Aug. 14, 2008

Related U.S. Application Data

(60) Provisional application No. 60/772,329, filed on Feb. 10, 2006.

(51) Int. Cl.
*B66D 1/00* (2006.01)

(52) U.S. Cl. ..... 254/323; 254/325; 114/197

(58) Field of Classification Search ..... 254/323, 254/325, 375, 376; 114/197
See application file for complete search history.

(56) References Cited

U.S. PATENT DOCUMENTS 4,516,515 A * 5/1985 Johnson ..... 114/197
4,771,987 A * 9/1988 Priest ..... 254/280
5,085,408 A * 2/1992 Norton et al. ..... 254/325
D380,726 S * 7/1997 Coulter ..... D12/317
5,806,380 A * 9/1998 Wilsey ..... 81/3.09
5,913,507 A * 6/1999 Lauricella, Jr. ..... 254/325
5,966,080 A * 10/1999 Bigsby ..... 340/686.4
6,227,132 B1 * 5/2001 Garcia ..... 114/197
6,928,943 B1 * 8/2005 Neubauer ..... 114/197
6,938,881 B2 * 9/2005 Grapes ..... 254/352
7,017,887 B1 * 3/2006 Verakis ..... 254/342
7,128,307 B2 * 10/2006 Dow ..... 254/342
7,152,546 B2 * 12/2006 Bernath ..... 114/197

* cited by examiner

*Primary Examiner*—Emmanuel M Marcelo

(57) ABSTRACT

Embodiments of the disclosure provide a receptacle for a boat drain plug, the receptacle being adapted to support the boat drain plug relative to a boat trailer, the boat trailer having a boat trailer winch, the boat trailer winch including a winch handle shaft, and the receptacle including an aperture sized to receive the boat drain plug, wherein the aperture is located in the winch handle shaft of the boat trailer winch.

21 Claims, 7 Drawing Sheets

BOAT DRAIN PLUG RECEPTACLE

CROSS REFERENCE TO RELATED APPLICATIONS

This application claims the benefit under 35 U.S.C. 119(e) of that certain U.S. Provisional Application Ser. No. 60/772,329, filed on or about Feb. 10, 2006, titled "Boat Drain Plug Receptacle", invented by Michael Beers of Austin, Tex., and filed with the U.S.P.T.O. by Larry Mason Lee (Reg. No. 28,873), the Serial Number of this specifically identified U.S. Provisional Application being presently misplaced.

BACKGROUND OF THE INVENTION

For many years boaters have trailered their boats to and from the water. When the boat is on the trailer it is always preferable to remove the boat's drain plug, so that lake water may be removed from the boat and rainwater does not build up in the boat's hull when storing the boat.

The boat operator must then remember to reinstall the drain plug before launching the boat into the water the next time the boat is to be used. If the operator forgets to reinstall the drain plug before launching the boat, the boat will probably sink. If it does not sink it will at least become swamped, resulting in an unpleasant if not costly scenario.

For years boaters have had a long-felt need to devise a way to help them remember to install the boat's drain plug before launching the boat. Many devices have come about to fill this need, from simple devices that attach the drain plug to the boat's ignition key, to the more elaborate devices that have electronic sensors that detect the absence of the drain plug when the boat is in the water and send an audible warning signal to the operator.

The biggest shortfall with these devices is that by the time the operator realizes that he has forgotten to install the drain plug, more than likely the boat has already been launched into the water. The above-mentioned shortcomings, disadvantages and problems are addressed herein, which will be understood by reading and studying the following specification.

SUMMARY OF THE INVENTION

Therefore a need has arisen for an invention that solves the problem of accidentally launching a boat without its drain plug. My disclosure makes it almost impossible to forget to install the boat's drain plug before launching, by storing the drain plug in the most logical place possible when not in use, and that would be on the boat trailer's winch handle. The winch handle will be the last thing the boat operator will see or touch before launching the boat, thus reminding the operator of the drain plug's location at a very crucial moment before launching the boat.

Apparatus of varying scope are described herein. In addition to the aspects and advantages described in this summary, further aspects and advantages will become apparent by reference to the drawings and by reading the detailed description that follows.

DETAILED DESCRIPTION OF THE INVENTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical mechanical and other changes may be made without departing from the scope of the embodiments. The following detailed description is, therefore, not to be taken in a limiting sense.

Figure 1:
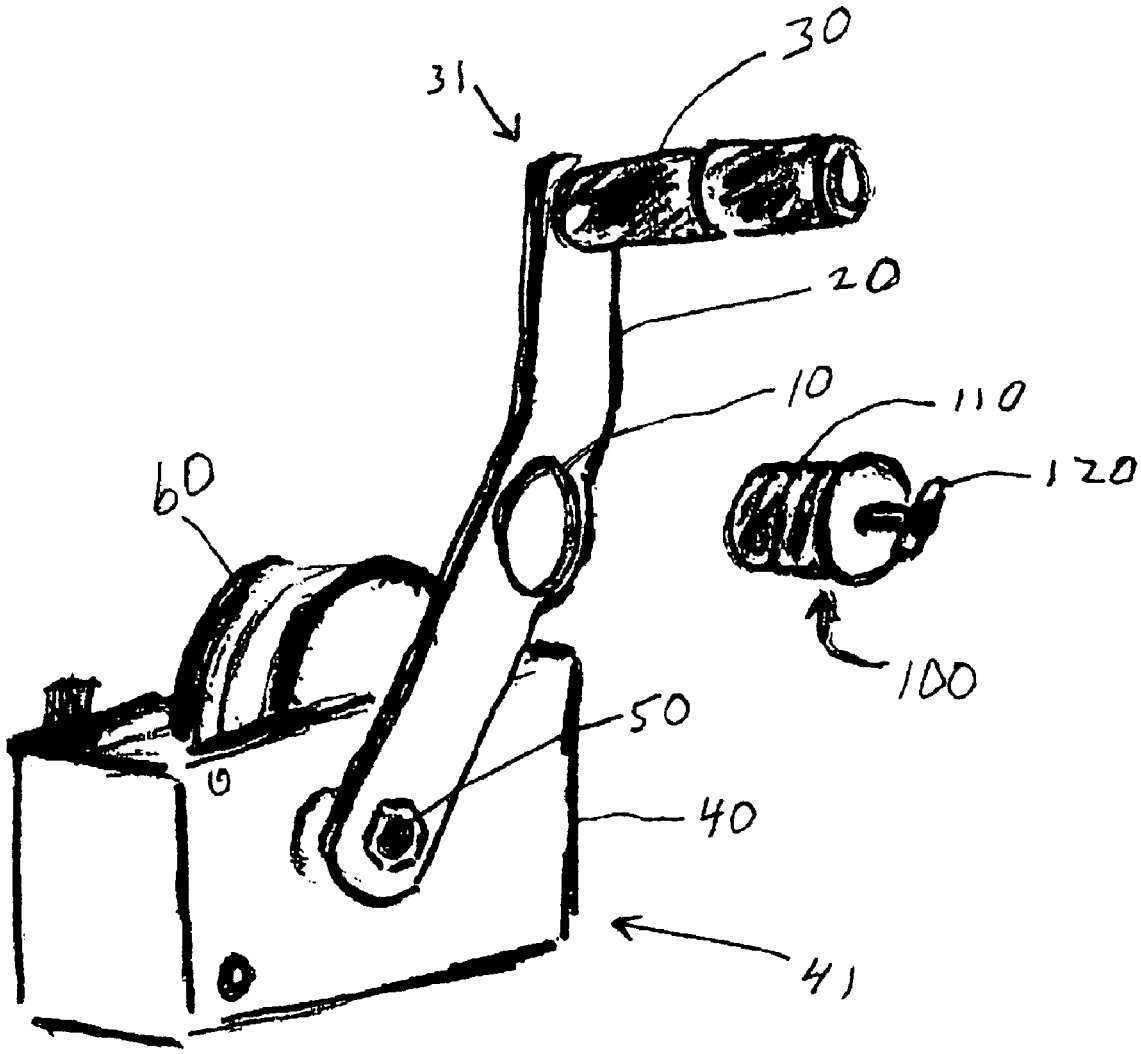
FIG. 1 is a perspective view illustrating an embodiment of the present disclosure.
Figure 6:
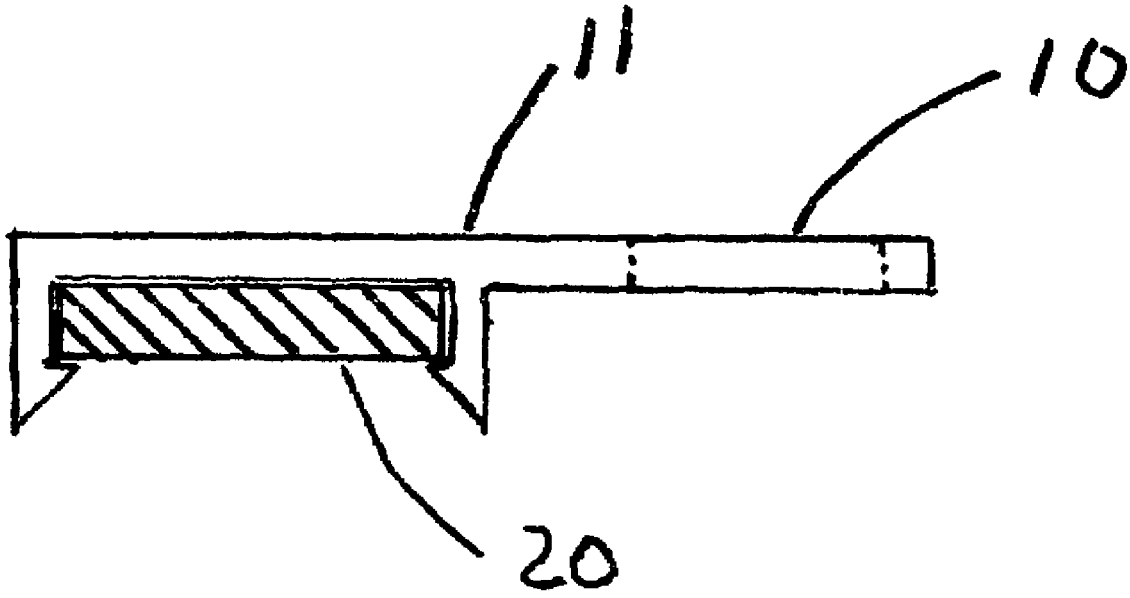
FIG. 6 is cross sectional view taken generally along line 6-6 in FIG. 5.
Figure 7:
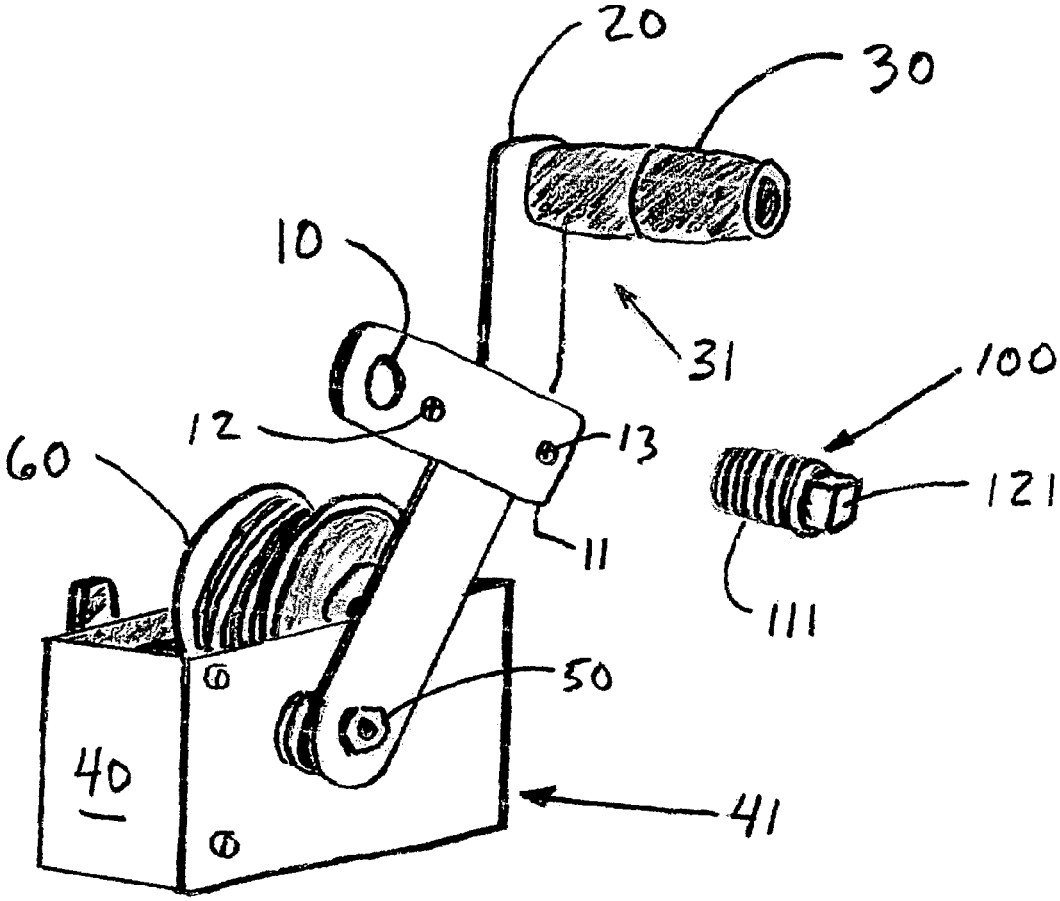
FIG. 7 is a perspective view similar to FIG. 2 and illustrates an embodiment having a threaded aperture.

FIG. 1 is a perspective view illustrating an embodiment of the present disclosure. The disclosure is of a boat drain plug receptacle which serves as a storage and warning device for a boat drain plug 100, which boat drain plug receptacle comprises an aperture 10 suitable for the receipt of a boat drain plug 100. The aperture 10 is necessarily sized to securely accommodate the boat drain plug shaft 110 or 111, as depicted in FIGS. 1 and 6 respectively, of the boat drain plug 100. As seen in FIG. 1, the aperture 10 is, in an embodiment, located in the shaft 20 of a winch handle 31 of a boat trailer winch 41. The winch handle 31 comprises a shaft 20, a connected handle grip 30 and connection to the gears pulley system 60 within the housing 40 of the boat trailer 41. The aperture 10 may be either threaded to receive the threads 111 of a boat drain plug 100, as depicted in FIG. 6, or non-threaded to receive the pressure fitting 110 of a boat drain plug 100, as depicted in FIG. 1. Further, the aperture 10, which acts as a receptacle for storing the boat's drain plug 100 on the winch handle 31, should be colored in red or any other bright color that would attract attention to the presence of the boat drain plug 100, thereby further assisting the boat trailer winch 41 operator in remembering to install to boat's drain plug 100 in the boat (not depicted) before launching the boat. One embodiment of the instant disclosure would be manufactured by constructing a winch handle 31 whose shaft 30 provides an integrated female receptacle or aperture 10 for the storage of a boat drain plug 100 on the winch handle 31 as shown in FIG. 1.

Figure 2:
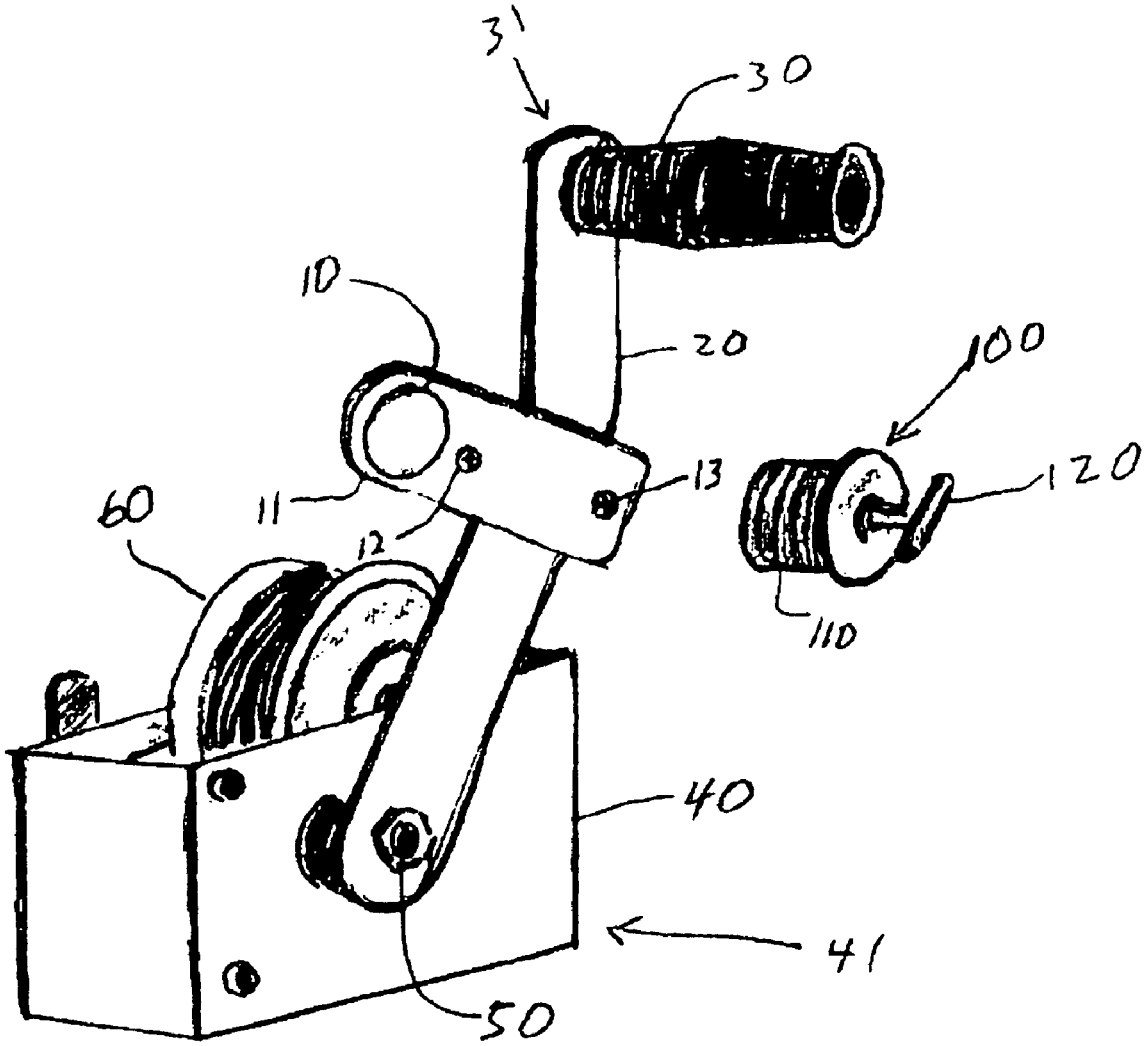
FIG. 2 is a perspective view illustrating a second embodiment of the disclosure.
Figure 3:
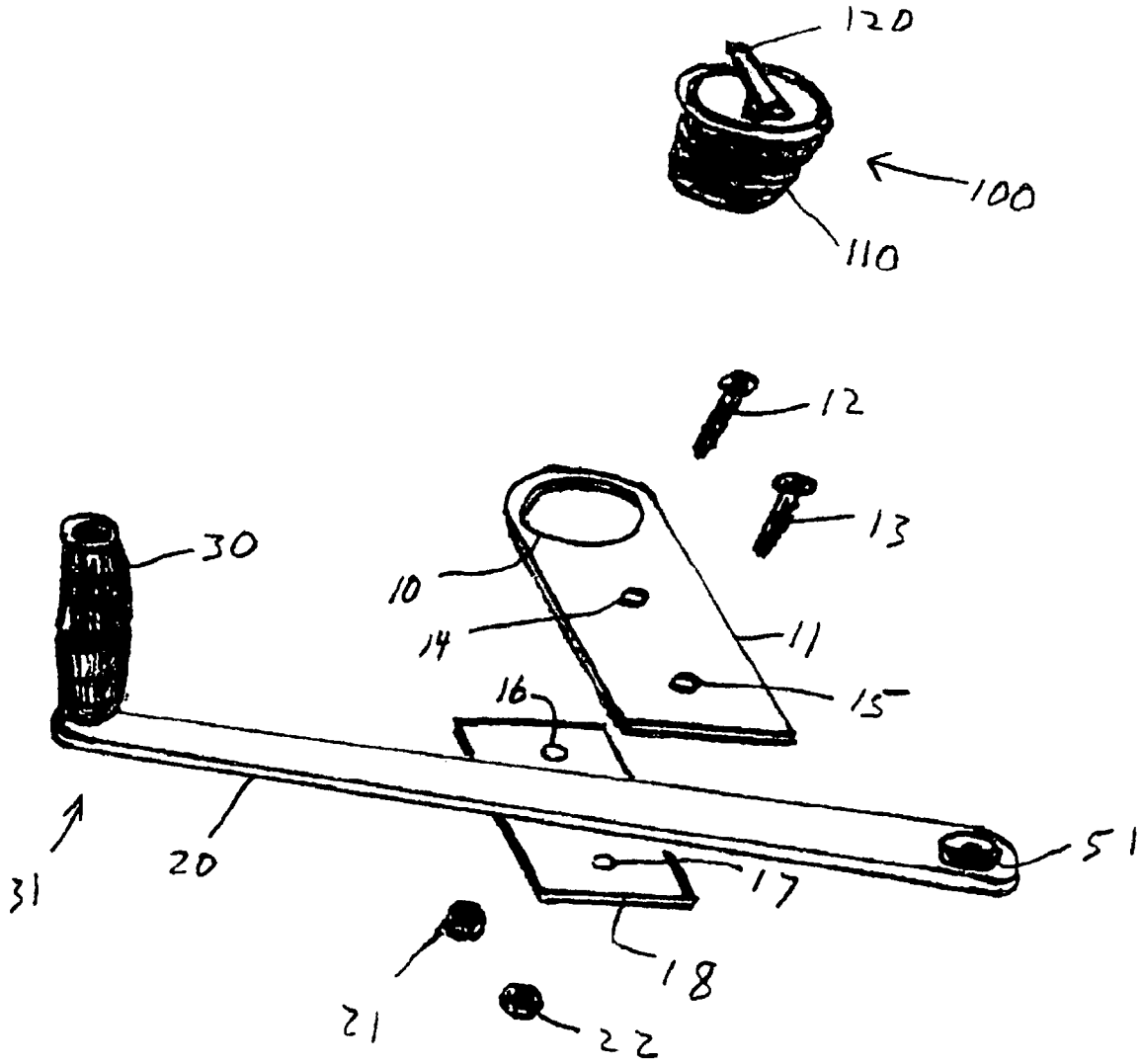
FIG. 3 is an exploded partial perspective view of the second embodiment shown generally in FIG. 2, with various parts simplified or omitted for clarity.
Figure 4:
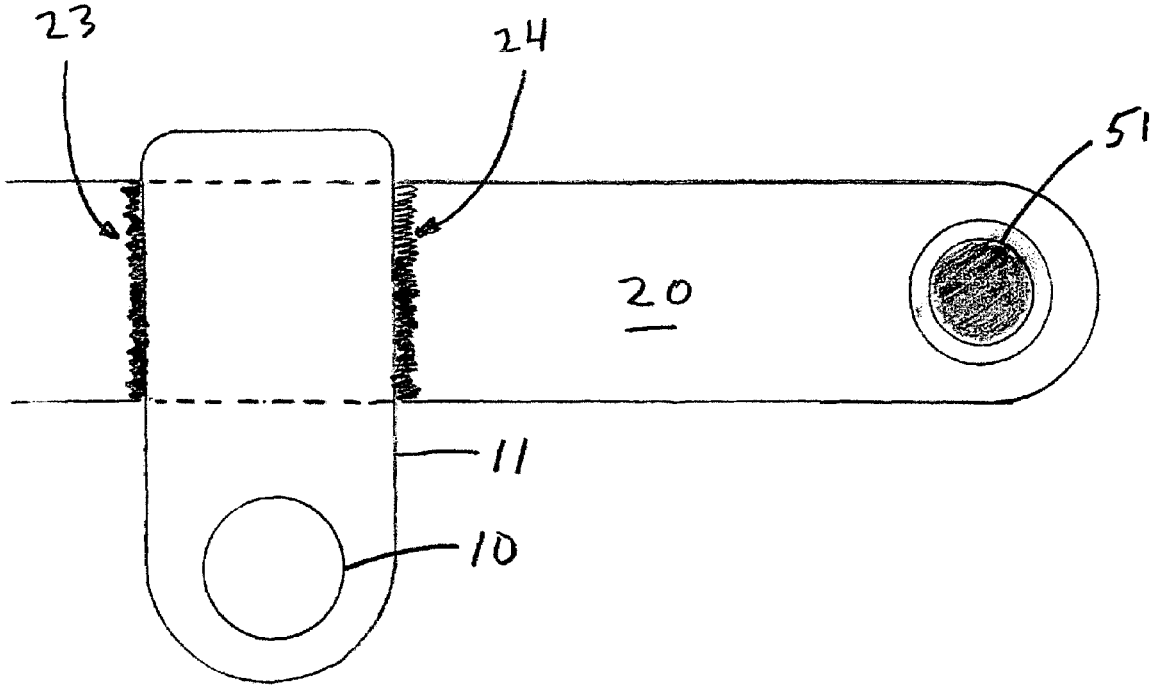
FIG. 4 is a partial view illustrating an embodiment having a receptacle supporting member welded to a shaft.

FIG. 2 is a perspective view illustrating a second embodiment of the instant disclosure. The second embodiment provides for the retrofitting of existing winch handles 31 by clamping or otherwise connecting a boat drain plug receptacle, comprising an aperture supporting member 11, to a winch handle 31 as depicted in FIG. 2. The boat drain plug receptacle depicted in FIG. 2 is again illustrated in exploded perspective view in FIG. 3. The boat drain plug receptacle of the second embodiment, depicted in FIG. 2 and FIG. 3, is thus seen to comprise an aperture supporting member 11, which provides screw holes 14 and 15, a clamp member 18, which provides screw holes 16 and 17, and the screws 12 and 13, with accompanying nuts 21 and 22, 30 which are sized to fit the screw holes 12, 13, 16, and 17. As depicted in FIG. 3, when the screws 12 and 13 are inserted through the holes 14 and 15 in the aperture supporting member 11 and the clamp member 18 is placed beneath the shaft 20 so that the screws 12 and 13 now protruding through the aperture supporting member 11 can be inserted through the screw holes 16 and 17 in the clamp member 18, and the nuts 21 and 22, respectively, are tightened onto the threaded ends of the screws 12 and 13, the aperture supporting member 11 is then firmly connected to the shaft 20. The connection of the aperture supporting member 11 to the shaft 20 may be accomplished in any of a myriad of ways. For example, as depicted in FIG. 4, the aperture supporting member 11 may be welded, as indicated by the presence of weld beads 23 and 24, to the shaft 20. It further is apparent that the connection means may be by application of adhesive (not depicted) or by the expedient of forming the shaft 20 and the aperture supporting member 11 as a single piece (not depicted).

Figure 5:
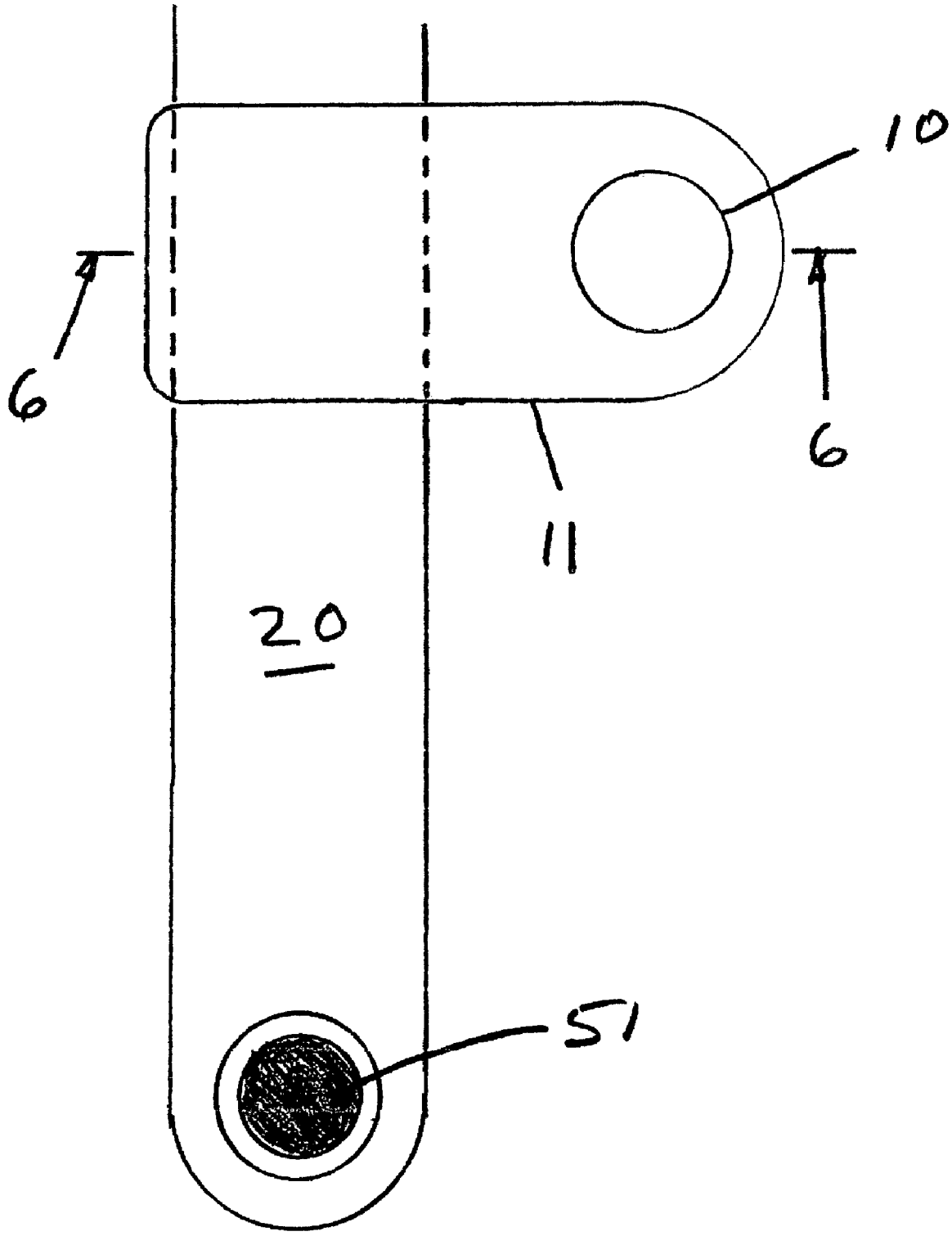
FIG. 5 is a partial view illustrating a third embodiment.

FIG. 5 is a partial view illustrating a third embodiment of the instant disclosure. FIG. 6 is a cross sectional view taken generally along line 6-6 in FIG. 5. The third embodiment of the instant disclosure is the forming, by machining or molding or otherwise, of the aperture supporting member 11 in such fashion that the aperture supporting member 11 provides a clamp surface which connects the aperture supporting member 11 to the shaft 20. The third embodiment of the instant disclosure provides the feature of being detachable and/or of forming a slidable connection whereby the aperture supporting member 11 may be connected to the shaft 20 at a height or location along the shaft 20 that the user finds convenient.

FIG. 6 is a perspective view similar to FIG. 2 and illustrates an embodiment having a threaded aperture 10 adapted to receive a threaded boat drain plug 100. FIG. 6 exists to depict a primary alternate configuration of the boat drain plug 100, and the embodiment illustrated in FIG. 6 differs from FIG. 2 only in the depiction of the boat drain plug 100 and compatible threads (not shown) in the aperture 10. The boat drain plug 100 depicted in FIG. 6 provides a threaded shaft 111 for screwable insertion into a boat bilge or, as pertinent to the instant disclosure, into a threaded aperture 10 for storage. The boat drain plug 100 depicted in FIG. 6 further provides a bolt head 121 connected to the threaded shaft 111 which facilitates the turning of the threaded shaft 111 when inserting the boat drain plug 100 into either a boat bilge or a threaded aperture 10 of the instant disclosure. The threads (not shown) interact with compatible threads of the threaded shaft 111 to securely hold the boat drain plug 100 in the threaded aperture 10. The boat drain plug 100 depicted in FIG. 1 and FIG. 2 provides an expandable shaft 110 with a connected boat plug handle 120 which, when turned, causes the expandable shaft 110 to shorten in length while expanding in diameter whereby the boat drain plug 100 may be securely held in a non-threaded aperture 10.

All embodiments of the instant disclosure have in common the fact that, in use, the boat drain plug 100 is inserted into the aperture 10 for storage while the user's boat is being hauled out of the water by the boat winch 41, the fact that the aperture 10 is obtrusively placed on, in, adjacent to or along the shaft 20 of the winch handle 31 so that the user will be easily aware of the boat drain plug's 100 presence, and the fact that the area surrounding or proximate the aperture 10 or the aperture supporting member 11 can be colored to attract the user's attention. According to the disclosure, the boat trailer thus includes visual warning indicia, such as the colored area, adapted to provide to a person using the boat trailer visual indication of at least one of the presence of the boat drain plug 100 in said aperture 10 or the absence of the boat drain plug 100 from said aperture 10. It is to be understood that any suitable visual warning indicia adapted to provide to a person using the boat trailer visual indication of at least one of the presence of the boat drain plug 100 in said aperture 10 and the absence of the boat drain plug 100 from said aperture 10 can be used. For example, instead of the visual warning indicia including a colored area surrounding or proximate the aperture 10, the boat trailer or aperture 10 can include surrounding or proximate the aperture 10, a visible pattern such as alternating warning stripes, which attracts a user's attention. Additionally, it is to be understood that embodiments of the disclosure provide a receptacle including an aperture 10 supported by a boat trailer, and the receptacle including aperture 10 is obtrusively located proximate the boat trailer winch. In an embodiment, the aperture 10 is located at least one of: on, in, proximate, adjacent, and along the winch handle of the boat trailer winch. The receptacle including aperture 10 thus is adapted to support the boat drain plug 100 relative to the boat trailer proximate the boat trailer winch 41 and the winch handle shaft 20. The instant disclosure will thereby provide the user with the dual functions of providing a secure storage location for the boat drain plug 100 and of providing the user with a warning indicator as to the presence or absence of the boat drain plug 100 in its assigned storage location. This dual function should substantially alleviate the oft encountered problem of launching a boat into the water without first installing the boat drain plug 100 into the boat, which problem routinely causes much needless foul language, bailing and distress among boating enthusiasts.

Although specific embodiments are illustrated and described herein, it will be appreciated by those of ordinary skill in the art that any arrangement which is calculated to achieve the same purpose may be substituted for the specific embodiments shown. This application is intended to cover all adaptations and variations. One of ordinary skill in the art will appreciate that implementations can be made in other embodiments that provide the required function. In particular, one of skill in the art will readily appreciate that the names of the apparatus and elements are not intended to limit embodiments of the disclosure. Furthermore, additional apparatus and elements can be added to the components, functions can be rearranged among the components, new components added or modified to correspond to future enhancements, and physical devices used in embodiments can be introduced without departing from the scope of embodiments. The terminology used in this application is meant to include all environments and alternate technologies which provide the same functionality as described herein. While embodiments of the instant invention have been described in substantial detail and fully and completely hereinabove, it will be apparent to one skilled in the art that numerous variations of the instant invention may be made without departing from the spirit and scope of the instant disclosure, and accordingly the instant disclosure is to be limited only by the following claims.

What is claimed is:

1. A receptacle for a boat drain plug, the receptacle being adapted to support the boat drain plug relative to a boat trailer, the boat trailer having a boat trailer winch, the boat trailer winch including a winch handle shaft, the receptacle comprising:

an aperture sized to receive the boat drain plug, wherein said aperture is located in the winch handle shaft.

2. The receptacle of claim 1 and further comprising:

the boat trailer having visual warning indicia adapted to provide to a person using the boat trailer visual indication of at least one of the presence of the boat drain plug in said aperture and the absence of the boat drain plug from said aperture.

3. The receptacle of claim 1 wherein an area proximate said aperture is colored to attract the attention of a person using the boat trailer.

4. The receptacle of claim 3 wherein an area surrounding said aperture is colored to attract the attention of a person using the boat trailer.

5. The receptacle of claim 1 wherein said aperture is threaded to screw ably receive a threaded boat drain plug.

6. The receptacle of claim 1 wherein said aperture is located proximate the winch handle shaft.

7. A boat trailer comprising a receptacle according to claim 1.

8. A receptacle for a boat drain plug, the receptacle being adapted to support the boat drain plug relative to a boat trailer, the boat trailer having a boat trailer winch, the boat trailer winch including a winch handle shaft, the receptacle comprising:

an aperture sized to receive the boat drain plug, and an aperture supporting member, wherein said aperture supporting member is adapted to be connected to the boat trailer winch, said aperture being located in said aperture supporting member.

9. The receptacle of claim 8 and further comprising:

the boat trailer having visual warning indicia adapted to provide to a person using the boat trailer visual indication of at least one of the presence of the boat drain plug in said aperture and the absence of the boat drain plug from said aperture.

10. The receptacle of claim 8 wherein an area proximate said aperture is colored to attract the attention of a person using the boat trailer.

11. The receptacle of claim 10 wherein an area surrounding said aperture is colored to attract the attention of a person using the boat trailer.

12. The receptacle of claim 8 wherein said aperture is threaded to screw ably receive a threaded boat drain plug.

13. The receptacle of claim 8 wherein said aperture is located proximate the winch handle shaft.

14. The receptacle of claim 13 wherein said aperture is located in the winch handle shaft.

15. A boat trailer comprising a receptacle according to claim 8.

16. A receptacle for a boat drain plug, the receptacle being adapted to support the boat drain plug relative to a boat trailer, the boat trailer having a boat trailer winch, the boat trailer winch including a winch handle shaft, the receptacle comprising:

an aperture, and an aperture supporting member, the aperture supporting member including a detachable connection, the detachable connection including a clamping surface for connecting the aperture supporting member to the boat trailer winch, wherein said receptacle is obtrusively located on the aperture supporting member.

17. The receptacle of claim 16 wherein said receptacle provides an aperture sized to receive a boat drain plug.

18. The receptacle of claim 16 and further comprising:

the boat trailer having visual warning indication adapted to provide to a person using the boat trailer visual indication of at least one of the presence of the boat drain plug in said aperture and the absence of the boat drain plug from said aperture.

19. The receptacle of claim 16 wherein an area proximate said aperture is colored to attract the attention of a person using the boat trailer.

20. A boat trailer winch configured to be mounted on a boat trailer, the boat trailer being adapted to support a boat for travel across dry ground, the boat trailer winch comprising:

a receptacle configured to receive a boat drain plug.

21. A boat trailer winch according to claim 20 and further comprising:

an aperture supporting member supporting the receptacle; and the receptacle including an aperture sized to receive the boat drain plug.

* * * * *